US005307252A

United States Patent [19]

Croup et al.

[11] Patent Number: 5,307,252

[45] Date of Patent: Apr. 26, 1994

[54] WALL SUPPORTED CHRISTMAS TREE

[76] Inventors: Marlene B. Croup; William H. Croup, both of P.O. Box 254, Marlborough, Conn. 06447

[21] Appl. No.: 916,485

[22] Filed: Jul. 20, 1992

[51] Int. Cl.[5] ..... A47G 33/06

[52] U.S. Cl. ..... 362/123; 428/18

[58] Field of Search ..... 428/18-20; 362/123; 156/61; 211/196, 205

[56] References Cited

U.S. PATENT DOCUMENTS

| | | | |
|---|---|---|---|
| 2,242,597 | 5/1941 | Quandee | 428/18 X |
| 2,864,192 | 12/1958 | Shoalts | 428/18 X |
| 2,911,748 | 11/1959 | Rodgers | D11/118 X |
| 3,027,671 | 4/1962 | Duvall | 428/18 X |
| 3,038,061 | 6/1962 | O'Reilly | 362/123 X |
| 3,857,748 | 12/1974 | Thomann | D11/118 X |
| 4,109,036 | 8/1978 | Lloyd et al. | 428/20 X |
| 4,161,768 | 7/1979 | Gauthier et al. | 428/20 X |
| 4,343,842 | 8/1982 | Chase | 428/20 X |
| 4,623,878 | 11/1986 | Schoenwetter | 428/18 X |
| 4,657,800 | 4/1987 | Long | 428/18 X |
| 4,805,075 | 2/1989 | Damore | 428/20 X |
| 4,847,123 | 7/1989 | Armstead et al. | 428/20 X |
| 4,968,541 | 11/1990 | McCrory | 428/20 X |

*Primary Examiner*—Henry F. Epstein
*Attorney, Agent, or Firm*—Leon Gilden

[57] ABSTRACT

A Christmas tree is provided with a planar rigid wall arranged for securement to a vertical wall surface within a dwelling. The invention is arranged to include support latches cooperative with sockets to position the tree rigid wall to the vertical wall of the dwelling.

3 Claims, 4 Drawing Sheets

WALL SUPPORTED CHRISTMAS TREE

BACKGROUND OF THE INVENTION

1. Field of the Invention

The field of invention relates to Christmas tree structure, and more particularly pertains to a new and improved wall supported Christmas tree apparatus wherein the same is arranged for mounting within a dwelling in contiguous communication to a vertical wall surface.

2. Description of the Prior Art

Christmas trees of various types have been provided throughout the prior art and are exemplified by the U.S. Pat. Nos. 4,343,842; 4,847,123; 4,161,768; and 4,805,075.

U.S. Pat. No. 4,968,541 sets forth an artificial Christmas tree arranged for support from an overlying hook structure relative to a ceiling within a dwelling.

The instant invention attempts to overcome deficiencies of the prior art by permitting the positioning and securement of a tree within a room of limited conventional space to position such a tree against a vertical wall surface and in this respect, the present invention substantially fulfills this need.

SUMMARY OF THE INVENTION

In view of the foregoing disadvantages inherent in the known types of Christmas tree structure now present in the prior art, the present invention provides a wall supported Christmas tree apparatus wherein the same is arranged for contiguous mounting relative to a vertical wall within a dwelling. As such, the general purpose of the present invention, which will be described subsequently in greater detail, is to provide a new and improved wall supported Christmas tree apparatus which has all the advantages of the prior art Christmas tree apparatus and none of the disadvantages.

To attain this, the present invention provides a Christmas tree with a planar rigid wall arranged for securement to a vertical wall surface within a dwelling. The invention is arranged to include support latches cooperative with sockets to position the tree rigid wall to the vertical wall of the dwelling.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wall supported Christmas tree apparatus which has all the advantages of the prior art Christmas tree apparatus and none of the disadvantages.

It is another object of the present invention to provide a new and improved wall supported Christmas tree apparatus which may be easily and efficiently manufactured and marketed.

It is a further object of the present invention to provide a new and improved wall supported Christmas tree apparatus which is of a durable and reliable construction.

An even further object of the present invention is to provide a new and improved wall supported Christmas tree apparatus which is susceptible of a low cost of manufacture with regard to both materials and labor, and which accordingly is then susceptible of low prices of sale to the consuming public, thereby making such wall supported Christmas tree apparatus economically available to the buying public.

Still yet another object of the present invention is to provide a new and improved wall support Christmas tree apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
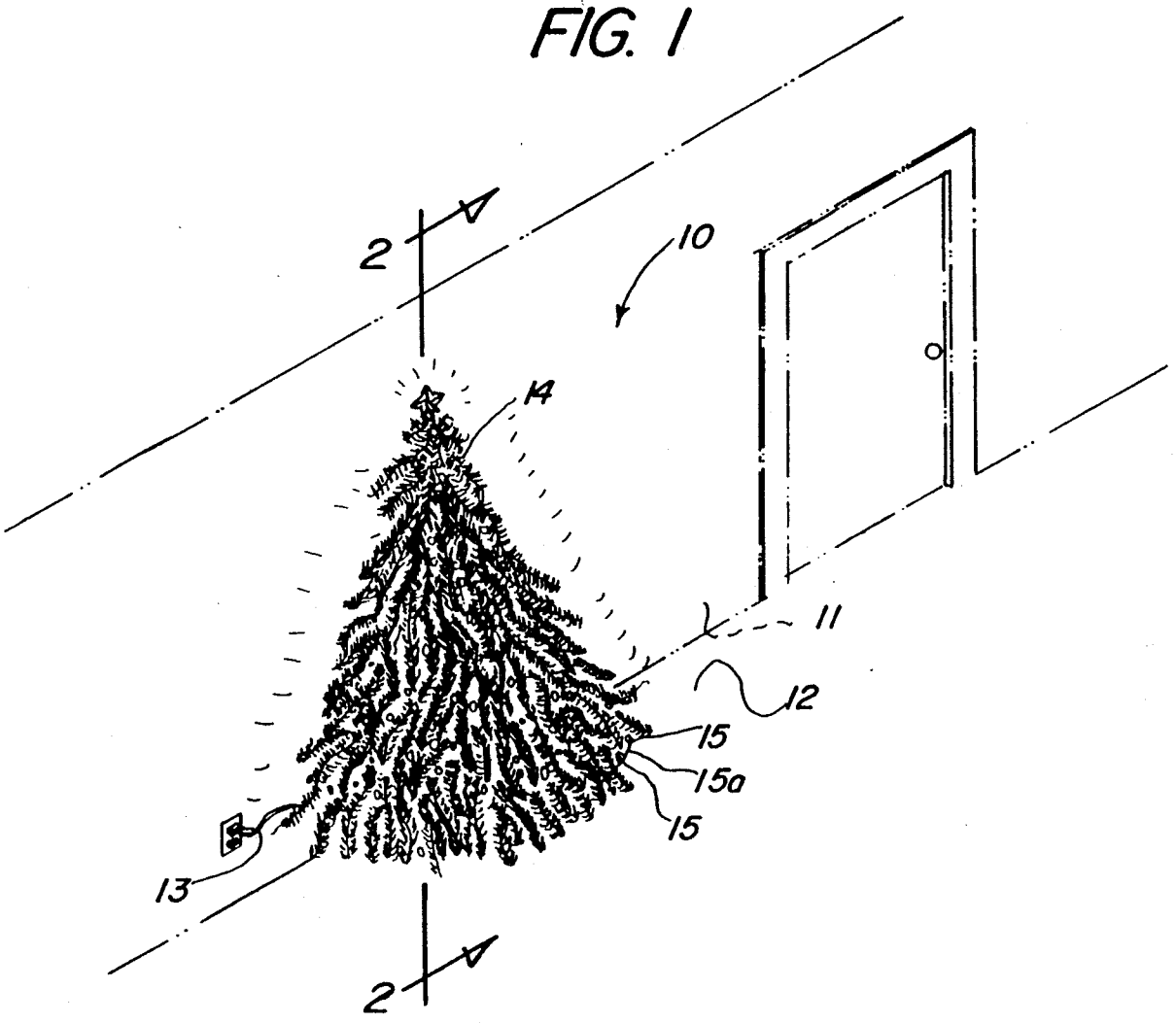
FIG. 1 is an isometric illustration of the invention mounted within a dwelling against a vertical wall surface.
Figure 3:
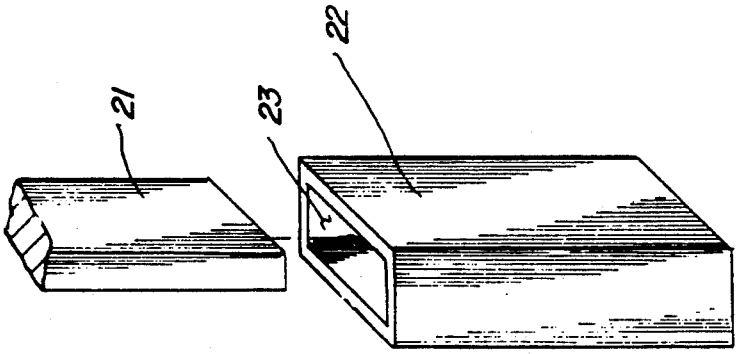
FIG. 3 is an isometric illustration of section 3 as set forth in FIG. 2.

With reference now to the drawings, and in particular to FIGS. 1 to 8 thereof, a new and improved wall supported Christmas tree apparatus embodying the principles and concepts of the present invention and generally designated by the reference numeral 10 will be described.

More specifically, the wall supported Christmas tree apparatus 10 of the instant invention is mounted to a vertical wall 11 within a dwelling in adjacency to a floor 12. An electrical power supply line 13 directs electrical power to the tree assembly 14 having a plurality of illumination light members 15 mounted relative to one another along an illumination light line 15*a*.

Figure 2:
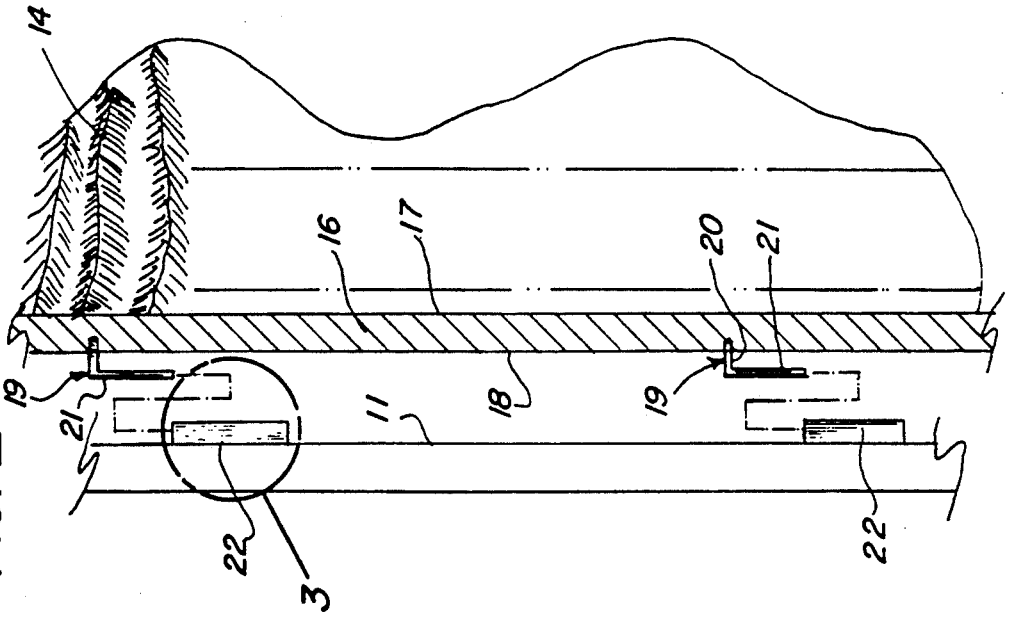
FIG. 2 is an orthographic view, taken along the lines 2—2 of FIG. 1 in the direction indicated by the arrows.
Figure 4:
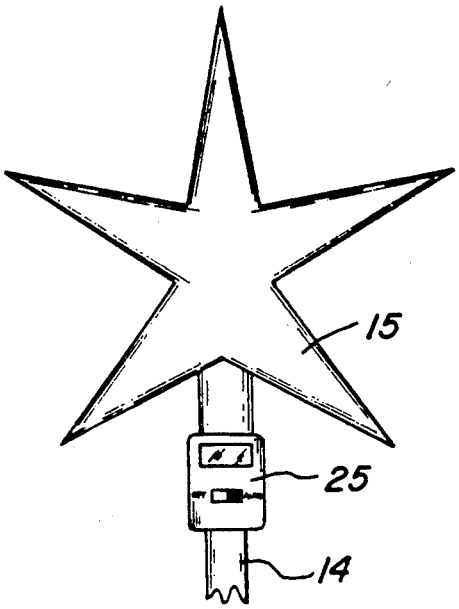
FIG. 4 is an orthogrpahic view of the Christmas tree illumination structure of the invention in association with a motion sensor switch.
Figure 5:
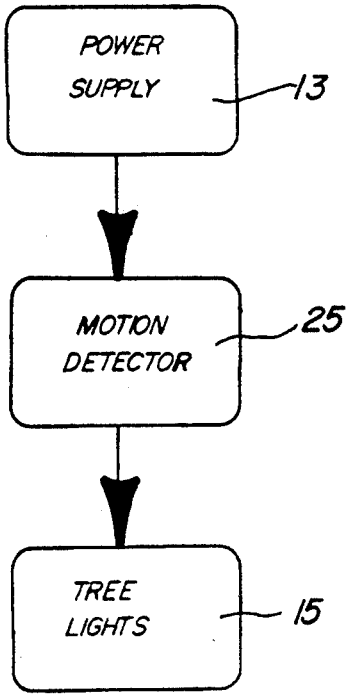
FIG. 5 is a diagrammatic illustration of the motion sensor switch relative to the Christmas tree lights and power supply.
Figure 6:
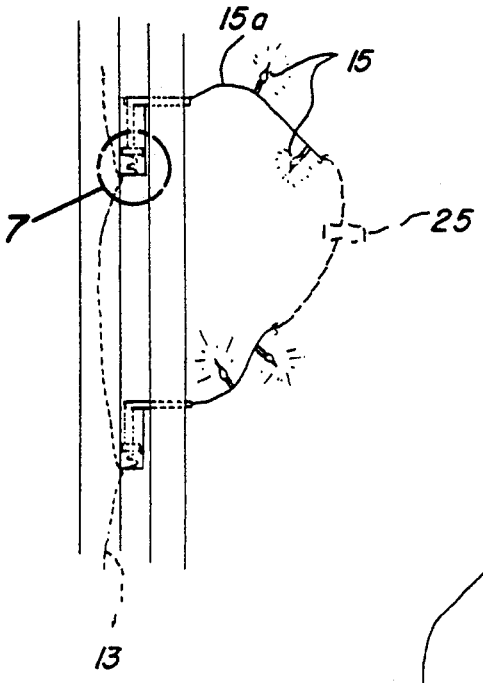
FIG. 6 is an orthographic side view of switch structure arranged relative to the support hook structure of the invention.
Figure 7:
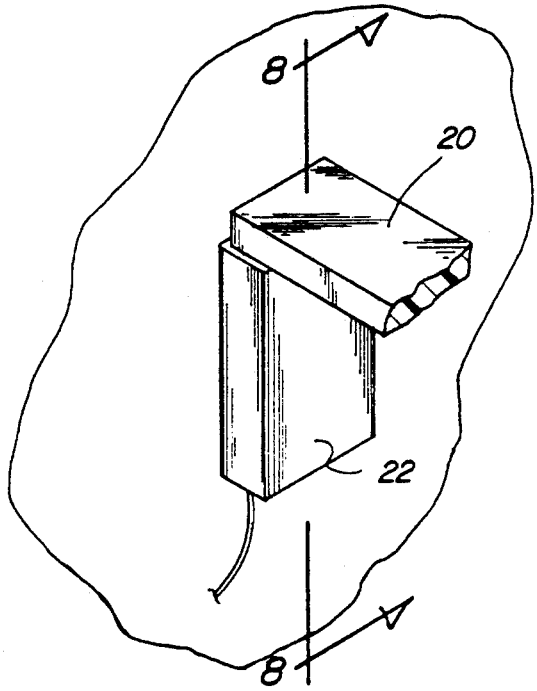
FIG. 7 is an isometric illustration of section 7 as set forth in FIG. 6.
Figure 8:
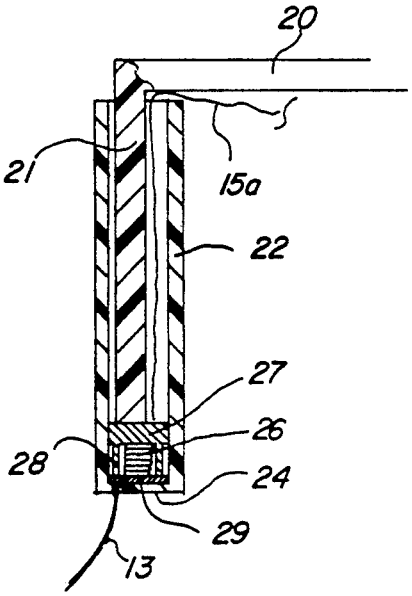
FIG. 8 is an orthographic view, taken along the lines 8—8 of FIG. 7 in the direction indicated by the arrows.

The tree assembly 14 includes a tree assembly planar rigid wall 16 mounting the semi-circular tree assembly 14 thereto, and more specifically to a wall front surface 17, wherein a wall rear surface 18 coextensive with the front surface 17 includes a plurality of L-shaped hooks 19 mounted thereon, wherein each L-shaped hook includes a first hook leg 20 orthogonally and integrally mounted to the rear surface 18 and a second hook leg 21 fixedly and orthogonally mounted to each first hook leg 20 in a spaced parallel relationship relative to the rear surface 18. Each second hook leg 21 extends downwardly relative to an associated first hook leg 20 for reception with a wall socket 22 of a plurality of wall sockets, wherein a like plurality of L-shaped hooks 19 are associated with a like plurality of wall sockets 22 to support the semi-circular tree assembly 14, in a manner as illustrated in FIG. 2 for example. As each of the sockets 22 includes a socket cavity 23 receiving the second hook leg 21, wherein each of the socket cavities 23 terminates in a lower socket floor 24.

The invention as indicated in the FIGS. 4–8 includes a motion detector 25 in electrical communication between the power supply 13 and the light members 15. The motion detector is thusly provided and mounted to an upper distal end of the tree assembly 14 for detecting motion such that the illumination members 15 will be actuated upon an individual present in relationship and adjacency relative to the organization 10.

Each of the sockets 22 includes a second switch plate 29 mounted contiguously to the socket floor for cooperation with a plurality of first switch plate legs 28 integrally and orthogonally mounted to a first switch plate 27. Intermediate the switch plate legs 28 is a polymeric spring member 26 to effect a spaced biasing of the first switch plate 27 relative to the second switch plate 29. Upon directing of each second hook leg 21 of each L-shaped hook 19 into a cavity 23 of an associated socket 22, the first switch plate 27 is depressed by a lower distal end of the second hook leg 21 to direct the first switch plate legs 28 into electrical communication to the second switch plate 29. In this manner, the electrical power supply line 13 in electrical communication with the second switch plate 29 is thereby in electrical communication to the illumination light line 15*a* that is directed to the first switch plate 27 to permit the illumination of the light members 15 and to thereby simultaneously indicate proper registration of each of the L-shaped hooks 19 with an associated socket 22.

As to the manner of usage and operation of the instant invention, the same should be apparent from the above disclosure, and accordingly no further discussion relative to the manner of usage and operation of the instant invention shall be provided.

With respect to the above description the, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wall supported Christmas tree, comprising, a rigid planar wall, the rigid planar wall having a semi-circular tree assembly mounted thereon, wherein said tree assembly includes an illumination light means having a plurality of illumination members for selective illumination of the light members, and the planar rigid wall includes a front surface spaced from, parallel to, and coextensive with a rear surface, the rear surface including a plurality of L-shaped hooks, and a plurality of wall sockets arranged for securement to a vertical wall, wherein each of the wall sockets includes a wall socket cavity, and each of the L-shaped hooks includes a first hook leg orthogonally and integrally mounted to the rear surface, and a second hook leg orthogonally and integrally mounted to the first hook leg oriented downwardly relative to the first hook leg, wherein the second hook leg is arranged for reception within one of said wall sockets.

2. A Christmas tree as set forth in claim 1 wherein each of the sockets includes a socket floor, and the illumination means includes a second plate switch mounted to the socket floor, and a first switch plate spaced from the socket floor, and a polymeric spring means interposed between the first switch plate and the second switch plate, and the first switch plate including a plurality of first switch plate legs orthogonally mounted to the first switch plate spaced from the second switch plate in a first position, and with the first switch plate legs in communication with the second switch plate in a second position, and wherein projection of one of said second hook legs into one of said sockets effects projection of said first switch plate towards the second switch plate, and an electrical power supply line in electrical communication with each of said second switch plates, and an illumination light electrical line in electrical communication with each of said first switch plates, wherein the illumination light line includes a plurality of illumination light members mounted thereon in electrical communication with said illumination light line, wherein projection of the first switch plate in electrical communication with the second switch plate effects electrical communication of the electrical power supply line with the illumination light members.

3. A Christmas tree as set forth in claim 2 wherein the illumination light line includes a motion sensor switch for closure of the switch upon sensing of motion relative to the tree assembly.

* * * * *